United States Patent [19]

Berkhof

[11] 4,436,506

[45] Mar. 13, 1984

[54] CONTROL SYSTEM FOR A GAS HEATED WATER OR AIR HEATER

[75] Inventor: Hendrikus Berkhof, Emmen, Netherlands

[73] Assignee: Honeywell B.V., Amsterdam, Netherlands

[21] Appl. No.: 368,486

[22] Filed: Apr. 14, 1982

[30] Foreign Application Priority Data

Apr. 13, 1981 [DE] Fed. Rep. of Germany ..... 3114954

[51] Int. Cl.[3] ..... F23N 5/00

[52] U.S. Cl. ..... 431/76; 431/12; 236/15 E

[58] Field of Search ..... 431/12, 20, 76, 90; 236/14, 15 E; 110/160

[56] References Cited

U.S. PATENT DOCUMENTS

| | | | |
|---|---|---|---|
| 3,300,133 | 1/1967 | Dines | 431/90 |
| 3,369,748 | 2/1968 | Baudelet de Livois | 236/15 E |
| 4,251,025 | 2/1981 | Ulrich et al. | 236/14 |
| 4,254,796 | 3/1981 | Kelly | 137/489 |
| 4,330,260 | 5/1982 | Jorgensen et al. | 431/12 |

FOREIGN PATENT DOCUMENTS

| | | | |
|---|---|---|---|
| 36613 | 3/1981 | European Pat. Off. . | |
| 3015980 | 4/1980 | Fed. Rep. of Germany . | |
| 925772 | 5/1963 | United Kingdom | 110/160 |
| 1235891 | 6/1971 | United Kingdom | 431/90 |

*Primary Examiner*—Lee E. Barrett

*Attorney, Agent, or Firm*—Clyde C. Blinn

[57] ABSTRACT

In a control system for a gas heated water or air heater, the use of the supplied fuel gas is to be improved by automatically determining and supplying the amount of air which is required for obtaining complete combustion. A gas control valve feeds a burner with the required amount of gas dependent on the demand of heat. A sensor responding to the content of oxygen or carbon dioxide within the flue gases is located in the stack and the output signal of this sensor is compared with a set point within an electric controller. In case of a control deviation, the output signal of the controller controls an adjustable source of air under pressure formed by a fan with subsequent air control valve in such a manner that the required amount of air for reaching optimum combustion is supplied.

4 Claims, 1 Drawing Figure

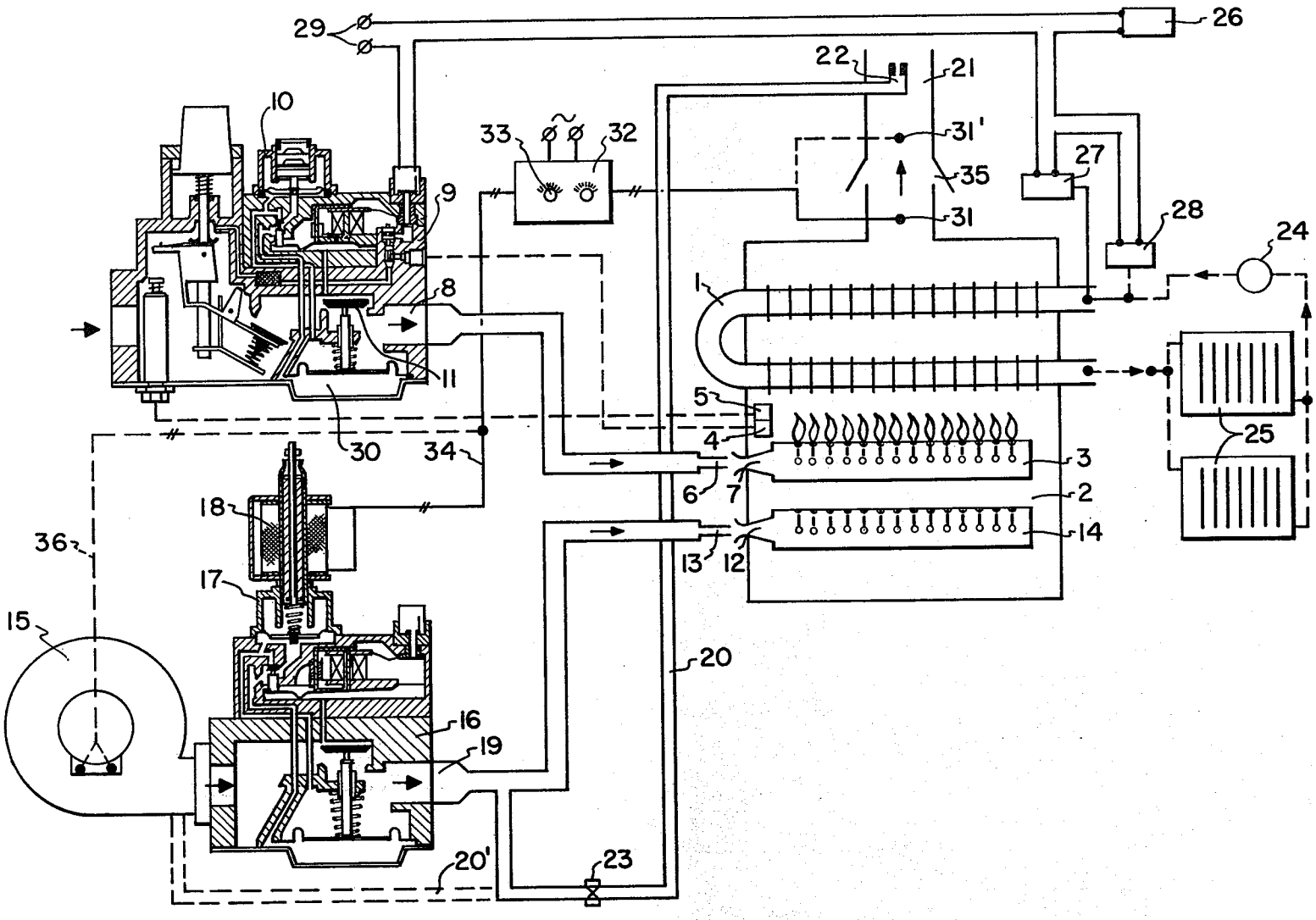
1
2
3
4
5
6
7
8
9
10
11
12
13
14
15
16
17
18
19
20
20'
21
22
23
24
25
26
27
28
29
30
31
31'
32
33
34
35
36

CONTROL SYSTEM FOR A GAS HEATED WATER OR AIR HEATER

BACKGROUND AND SUMMARY OF THE INVENTION

The invention relates to a control system known for instance from British Pat. No. 12 35 891. While in former times water and air heaters in private homes as well as in central heating systems were generally operated with gas of about the same heating value, today gases are offered such as manufactured gas, natural gas and liquified gas which differ from each other with respect to their heating value as well as with respect to the required amount of combustion air for achieving complete combustion. As characterizing value for the heat content and the density of the gas, usually the so-called Wobbe index is used which for the various kinds of gases has essentially different values. For optimum use of the fuel it is desired to reach almost complete combustion with little excess of air. While for burning 1 $m^3$ of manufactured gas about 3 to 4 $m^3$ of air are required, for burning 1 $m^3$ natural gas one needs about 8 $m^3$ and for burning 1 $m^3$ butane about 30 $m^3$ are necessary.

Since burners and the associated control equipment in most cases are adjusted to a predetermined kind of gas, and, if necessary, by particular service measures can be changed to another kind of gas, the gas supply companies have tried to remove the difficulties for their customers arising from the supply of different kinds of gases by mixing the fuel gas with an auxiliary gas, for instance air or nitrogen such that independently from the kind of gas, the gas supply network is supplied with a gas having about the same Wobbe index. Such mixing apparatus, however, are expensive and require a strong monitoring with respect to safety requirements in order to prevent that without the supply of additional combustion air, a burnable gas mixture is flowing through the supply network or can be formed in the piping.

The invention therefore strives for a water or air heater which can be heated by gas of different Wobbe index. This object is achieved by a control system of the kind as characterized in claim 1. By the invention it is possible to operate the burner in an optimized manner, that means with complete combustion of the fuel gas with low excess of air and therewith to use the supplied fuel as well as possible in spite of different heating values of the gases.

The use of oxygen or carbon dioxide sensors for monitoring the exhaust gases of combustion motors and the exhaust gas of power stations and industrial plants is known as such. The invention acccmplishes by the use of such known sensors a control system which allows to operate the water or air heater with different kinds of gases and simultaneously makes optimum use of the fuel gas. Preferred embodiments of the invention are described in the subclaims.

DESCRIPTION OF THE SINGLE FIGURE

A single FIGURE drawing shows a control system for a gas heated boiler of a hot water central heating system.

DESCRIPTION OF THE INVENTION

The heat exchanger 1 of a water heater or boiler 2 is heated by a main burner 3 to which are associated a pilot burner 4 and a thermocouple 5 monitoring the pilot flame. Gas is supplied to the main burner 3 via an injector nozzle 6 which, in view of its suction action, simultaneously supplies primary air to the burner 3. The injector nozzle 6 is located opposite inlet 7 of the main burner and is connected to outlet 8 of gas control apparatus 9. This control apparatus in the shown embodiment is structured as known from Honeywell printed matter D3H-29 Honeywell Compact Valves V4600/V8600 and comprises a servo pressure regulator together with a main gas valve 11 controlled by the outlet control pressure of the servo pressure regulator 10.

Since the primary air sucked by means of gas nozzle 6 is not sufficient for achieving complete combustion, housing 2 of the heater further has an air inlet 12 with a second injector nozzle 13 being located opposite said air inlet 12. This inlet 12 ports into a manifold 14 for secondary air which has the structure of a burner tube and is provided with air outlet openings. Air under pressure for the secondary air nozzle 13 is delivered by fan 15 to which an air control valve 16 is connected in series. Again, this is a pressure controlled diaphragm valve, the control pressure of which is generated by a servo pressure regulator 17. While in the shown embodiment servo pressure regulator 10 of the gas control apparatus 9 operates with a manually adjustable set point, the set point of the servo pressure regulator 17 for the air control valve 16 can be adjusted by means of a solenoid 18.

Connected to the outlet 19 of the air control valve 16 is further a pipe 20 which leads to an air nozzle 22 located in the stack 21. This nozzle 22 generates an artificial draft in the stack 21 or chimney. By means of a throttle 23 provided in pipe 20, the amount of air supplied to nozzle 22 can be adjusted. Pipe 20 to nozzle 22 may also be connected directly to fan 15 as is shown in dotted lines in the form of pipe 20'.

The water heated in heat exchanger 1 is pumped by means of a circulation pump 24 through the heating fluid circuit which is shown in the form of 2 radiators 25. A room thermostat 26 closes its contact as soon as the measured room temperature is below its set point. Boiler thermostat 27 closes its contact as soon as the water temperature at the inlet of heat exchanger 1 is below a set point which preferably is adjustable. Finally, there is a temperature limit switch 28 which opens the circuit as soon as an upper limit of the water temperature at the outlet of heat exchanger 1 is exceeded. The three mentioned thermostat switches are connected in series with the energizing coil of a switch-on solenoid valve provided within gas control apparatus 9 and are further connected to a voltage source 29. If the room temperature falls below its set point and if simultaneously the return water temperature is not sufficiently high, the gas control apparatus 9 is switched on via the above mentioned switch-on solenoid valve. Its pressure regulator 10 generates a control pressure which becomes effective in the operating chamber 30 of main gas valve 11 and moves its closure member away from its seat. Gas flows to the main burner 3 and is ignited by pilot burner 4 with the resulting flames heating the water in heat exchanger 1.

Since the primary air sucked by means of injector nozzle 3 is not sufficient for reaching complete combustion, the sensor 31 located in stack 21 measures that the oxygen content or the carbon dioxide content is too low. The measuring value is compared with a set point adjusted by set point potentiometer 33 at electrical controller 32. If the oxygen content or the carbon dioxide content is too low, controller 32 delivers a current on lead 34 to solenoid operator 18 of servo pressure regulator 17. By this current, the set point of the servo pressure regulator is increased via the solenoid operator and a further opening of the air control valve 16 is effected. In this manner, a bigger amount of secondary air is fed via air nozzle 13 to air manifold 14, and therewith combustion is improved. If, as shown in the embodiment, stack 21 is provided with a draft interruption 35, it might be more favorable to provide sensor 31' downstream of draft interruption 35 because the sensor then is less heated. In this case, however, the influence of the air stream sucked via draft interruption 35 has to be considered when determining the set point for the oxygen content or carbon dioxide content. If the oxygen content exceeds the set point, sensor 31 sends a signal to electrical controller 32 which, via solenoid operator 18 and servo pressure regulator 17, reduces the control pressure for air control valve 16. Therewith its closure member is moved in closing direction and the amount of secondary air is reduced.

Instead of controlling the amount of secondary air by means of a solenoid operator and a servo pressure regulator as shown in the embodiment, the output signal of electric controller 32 might be used directly for controlling the speed of fan 15 as this is indicated by dotted electrical line 36.

The embodiments of the invention in which an exclusive property or right is claimed are defined as follows:

1. Control system for a gas heated water or air heater having a gas control valve controlled by a temperature sensor and comprising a control member for the supply of combustion air which is controlled dependent on the gas flow, comprising a sensor for the content of oxygen or carbon dioxide in the flue gases is provided in the stack of the heater connected to an electric controller, the output signal of which controls the control member for the air volume, and further comprising a fan and a control valve connected in series with the fan and used as a controllable source of combustion air, wherein the control valve comprises a servo pressure regulator as well as a diaphragm operator for the control member of the control valve operated by the output pressure of the pressure regulator, and that a solenoid operator determining the set point of the pressure regulator is mounted on the servo pressure regulator and is controlled by the output signal of the electric controller.

2. Control system according to claim 1, wherein the output signal of the electric controller controls the speed of a fan which is used as combustion air source.

3. Control system according to claim 1, wherein:

(a) the outlet of the gas control valve is connected to an injector nozzle which is located opposite the inlet of a burner and simultaneously sucks primary air for the burner;

(b) burner and a heat exchanger surface heated by said burner are surrounded by a closed housing which has a secondary air inlet and a stack; and (c) the controllable source of combustion air is connected to a second injector nozzle which is located opposite the secondary air inlet and, during operating, sucks secondary air.

4. Control system according to claim 1, with an air nozzle means provided in stack for generating artificial draft, wherein the sensor is provided in stack upstream of air nozzle.

* * * * *